US006848183B2

(12) United States Patent
Lemisch

(10) Patent No.: US 6,848,183 B2
(45) Date of Patent: Feb. 1, 2005

(54) THUMB LOCK FOR A BUTTERFLY KNIFE

(76) Inventor: Adam M. Lemisch, 29005 N. 51st Pl., Cave Creek, AZ (US) 85331

( * ) Notice: Subject to any disclaimer, the term of this patent is extended or adjusted under 35 U.S.C. 154(b) by 0 days.

(21) Appl. No.: 10/818,427

(22) Filed: Apr. 5, 2004

(65) Prior Publication Data

US 2004/0181946 A1 Sep. 23, 2004

Related U.S. Application Data

(63) Continuation-in-part of application No. 10/217,663, filed on Aug. 12, 2002, now Pat. No. 6,715,208.

(51) Int. Cl.[7] ..... B26B 3/06
(52) U.S. Cl. ..... 30/153; 30/161; 30/340
(58) Field of Search ..... 30/153–155, 157, 30/161, 340; 7/118

(56) References Cited

U.S. PATENT DOCUMENTS

| | | | | | |
|---|---|---|---|---|---|
| 881,294 | A | * | 3/1908 | Billings | 30/153 |
| 1,659,418 | A | * | 2/1928 | Werner | 30/153 |
| 1,665,955 | A | * | 4/1928 | Gatewood | 30/153 |
| 2,820,291 | A | * | 1/1958 | Philippar | 30/153 |
| 4,330,937 | A | * | 5/1982 | Cope | 30/153 |
| 4,364,174 | A | * | 12/1982 | De Asis | 30/153 |
| 4,547,965 | A | * | 10/1985 | Moore | 30/153 |
| 4,648,145 | A | * | 3/1987 | Miceli | 7/158 |
| 4,669,140 | A | * | 6/1987 | Miceli | 7/158 |
| 4,672,743 | A | * | 6/1987 | Grahm | 30/153 |
| 5,782,001 | A | * | 7/1998 | Gray | 30/391 |
| 6,195,898 | B1 | * | 3/2001 | Lemisch | 30/153 |
| 6,715,208 | B2 | * | 4/2004 | Lemisch | 30/153 |

* cited by examiner

*Primary Examiner*—Boyer D. Ashley
(74) *Attorney, Agent, or Firm*—Jeffrey D. Moy; Harry M. Weiss; Weiss, Moy & Harris, P.C.

(57) ABSTRACT

A locking mechanism is coupled to a distal end of the butterfly knife for securing the butterfly knife in an open position and in a closed position. The locking mechanism has a movable magnetic component coupled to a distal end of the first handle component. The magnetic component is magnetically coupled to a metallic surface of the second handle component to lock the butterfly knife. At least one spring device is movably coupled to the magnetic component. The spring device is used for moving the magnetic component in a downward manner to free the magnetic component from the metallic surface of the second handle component to unlock the butterfly knife.

7 Claims, 5 Drawing Sheets

THUMB LOCK FOR A BUTTERFLY KNIFE

RELATED APPLICATION

This application is a CIP of U.S. patent application Ser. No. 10/217,663, now U.S. Pat. No. 6,715,208, filed Aug. 12, 2002, naming Adam M. Lemisch as the inventor, and entitled "A THUMB LOCK FOR A BUTTERFLY KNIFE". This application is related to U.S. Pat. No. 6,195,898 filed Dec. 4, 1998, naming Adam M. Lemisch as the inventor, and entitled "MAGNETICALLY LATCHING BUTTERFLY KNIFE."

BACKGROUND OF THE INVENTION

1. Field of the Invention

This invention relates generally to knives, and more specifically, to a device for locking a knife, specifically a butterfly knife.

2. Background of the Invention

A butterfly knife generally has a blade, a first and second handle component hinged to the blade, and a latch. The latch includes a swinging portion coupled to a distal end of the first handle component and a receiving slot at a distal end of the second handle component. The latch works by having the swinging portion fittingly engage into the receiving slot to be able to lock the knife into an open and usable position and to also be able to lock the knife into a closed and stored position.

A latching mechanism used in conjunction with a butterfly knife may be cumbersome to latch and/or unlatch. Furthermore, the latch may become loose and will not properly hold the knife in either the open or closed position. An unreliable latch may cause the knife to unexpectedly open or close, thus leading to the injury of the user or to others. Also, it is desired that these knives be easily and quickly opened or closed by the user, especially in instances such as emergency and/or combat situations. It is a continued need and desire to provide latches or locks for butterfly knives that are more simplistic, easier, and safer to use. Furthermore, devices or components for helping the user move a butterfly knife between the open and the closed positions are continuously needed and desired as well.

Therefore, a need existed to provide a more reliable device for locking a butterfly knife. The device should be more simplistic, less cumbersome, and more reliable to use than prior art latches. The device must provide further safety and less hazard to the user and to others. The device must also be able to be moved relatively quickly between the open and closed positions.

SUMMARY OF THE INVENTION

In accordance with one embodiment of the present invention, it is an object of the present invention to provide an improved device for locking a butterfly knife.

It is another object of the present invention to provide an improved device for locking a butterfly knife that is more simplistic, less cumbersome, and more reliable to use than prior art locking mechanisms.

It is another object of the present invention to provide a device for locking a butterfly knife that is safer and less hazardous to the user and to others than prior art locking devices.

It is also another object of the invention to provide a device for locking a butterfly knife that allows the knife to be moved relatively quickly between the open and closed positions.

BRIEF DESCRIPTION OF THE PREFERRED EMBODIMENTS

In accordance with one embodiment of the present invention a device for locking a butterfly knife having a first handle component, a second handle component, and a blade hingedly coupled at a proximal end of the butterfly knife wherein the first and second handle components are moved to an open position and a closed position is disclosed. The locking mechanism is coupled to a distal end of the butterfly knife for securing the butterfly knife in an open position and in a closed position. The locking mechanism has a movable magnetic component coupled to a distal end of the first handle component. The magnetic component is magnetically coupled to a metallic surface of the second handle component to lock the butterfly knife. At least one spring device is movably coupled to the magnetic component. The spring device is used for moving the magnetic component in a downward manner to free the magnetic component from the metallic surface of the second handle component to unlock the butterfly knife.

The foregoing and other objects, features, and advantages of the invention will be apparent from the following, more particular, description of the preferred embodiments of the invention, as illustrated in the accompanying drawing.

BRIEF DESCRIPTION OF THE DRAWINGS

The novel features believed characteristic of the invention are set forth in the appended claims. The invention itself, as well as a preferred mode of use, and advantages thereof, will best be understood by reference to the following detailed description of illustrated embodiments when read in conjunction with the accompanying drawings, wherein like reference numerals and symbols represent like elements.

DETAILED DESCRIPTION

Figure 1:
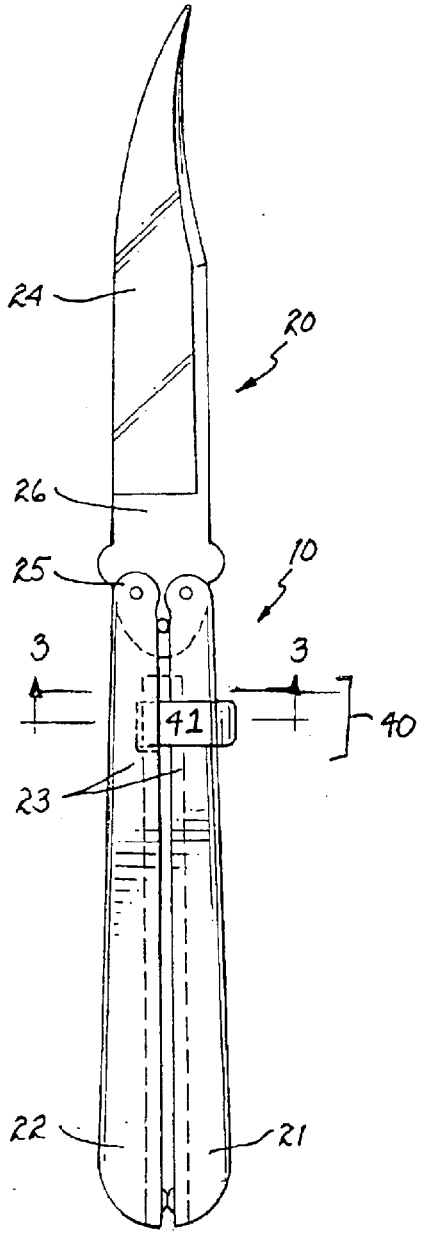
FIG. 1 is a side view of a butterfly knife with one embodiment of the thumb lock of the present invention wherein the butterfly knife is in the open and usable position.

Referring to FIGS. 1–12 wherein like numerals and symbols represent like elements, a thumb lock for a butterfly knife 10 (hereinafter thumb lock 10) is shown. The thumb lock 10 is used to secure a butterfly knife 20 in an open position and also in a closed position. The thumb lock 10 is preferred, but not required, to be located at the proximal end 25 of the butterfly knife 20 to make it easier to unlock, safer, and able to be moved relatively quickly between the open and closed positions.

Figure 2:
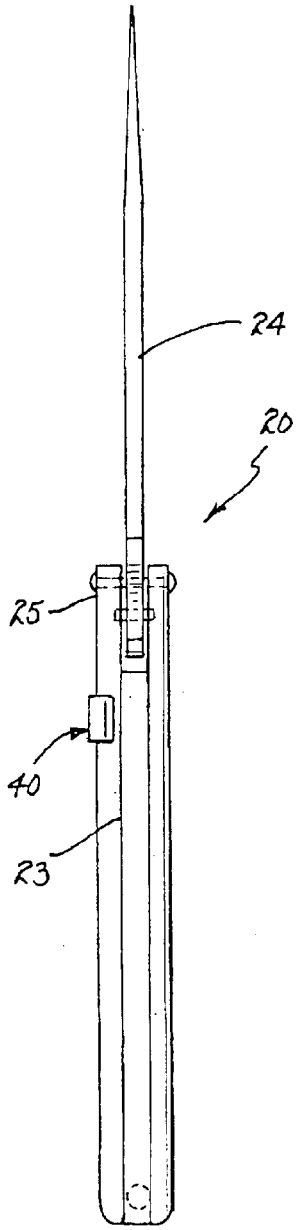
FIG. 2 is a front view of a butterfly knife with the thumb lock of FIG. 1 wherein the butterfly knife is in the open and usable position.
Figure 3:
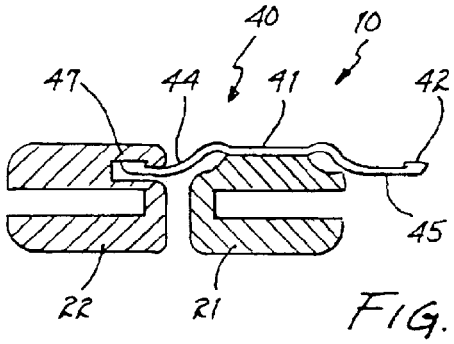
FIG. 3 is a cross-sectional view of the thumb lock used in the butterfly knife of FIG. 1, taken along line 3—3 of FIG. 1, wherein the butterfly knife is in the open and usable position.
Figure 4:
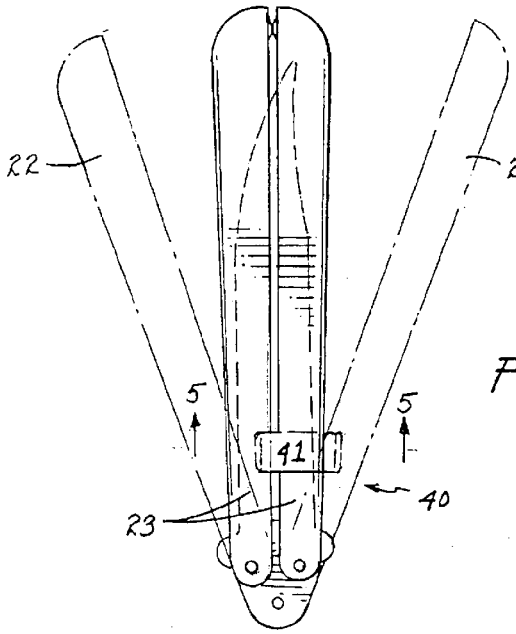
FIG. 4 is a side view of the butterfly knife with the thumb lock depicted in FIG. 1 wherein the butterfly knife is in the closed and stored position.
Figure 5:
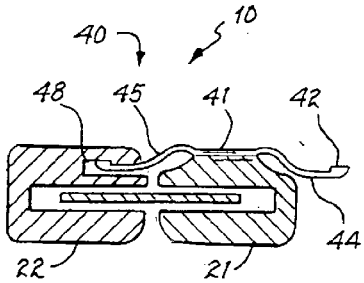
FIG. 5 is a cross-sectional view taken along lines 5—5 of FIG. 4 of the thumb lock used in the butterfly knife wherein the butterfly knife is in the closed and stored position.
Figure 7:
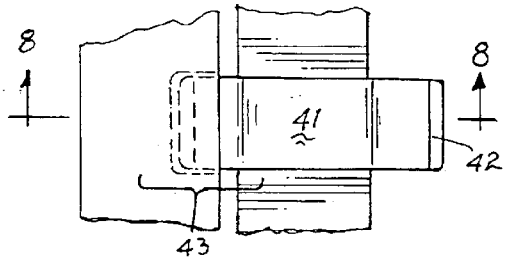
FIG. 7 is a partial side view of a butterfly knife with the thumb lock of FIG. 1.
Figure 6:
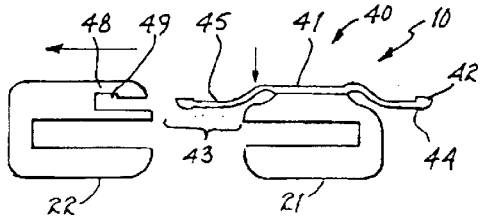
FIG. 6 is a cross-sectional view of the thumb lock used in the butterfly knife of FIG. 1 wherein the thumb lock is in the partially open position.
Figure 8:
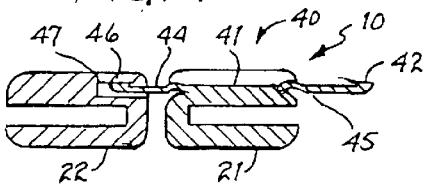
FIG. 8 is a cross-sectional view, taken along line 8—8 of FIG. 7, with the thumb lock of FIG. 1 wherein the butterfly knife is in the open and usable position.
Figure 9:
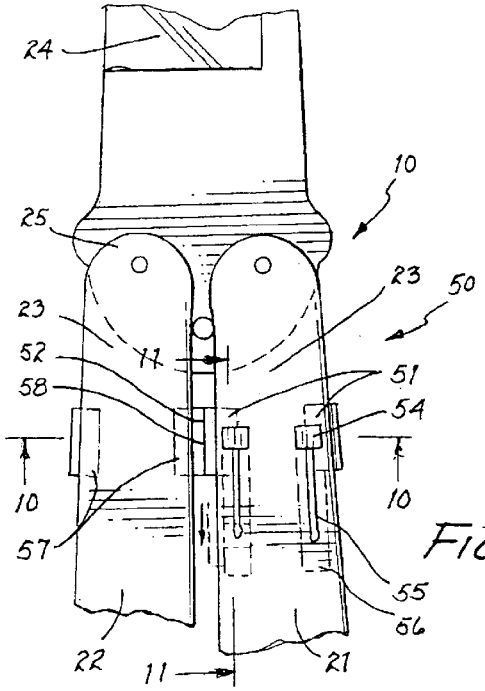
FIG. 9 is a partial side view of a butterfly knife with another embodiment of the thumb lock of the present invention wherein the butterfly knife is in the open and usable position.
Figure 11:
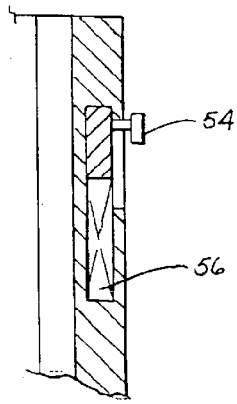
FIG. 11 is a partial side view of the butterfly knife with the thumb lock of FIG. 9.
Figure 10:
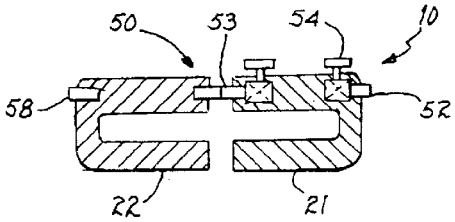
FIG. 10 is a cross-sectional view, taken along line 10—10 of FIG. 9, of the thumb lock of FIG. 9 with the butterfly knife in the closed and stored position.
Figure 12:
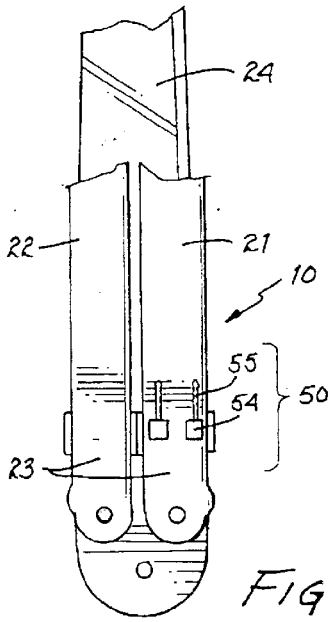
FIG. 12 is a partial side view of a butterfly knife with the thumb lock of FIG. 9 wherein the butterfly knife is in the closed and stored position.
Figure 13:
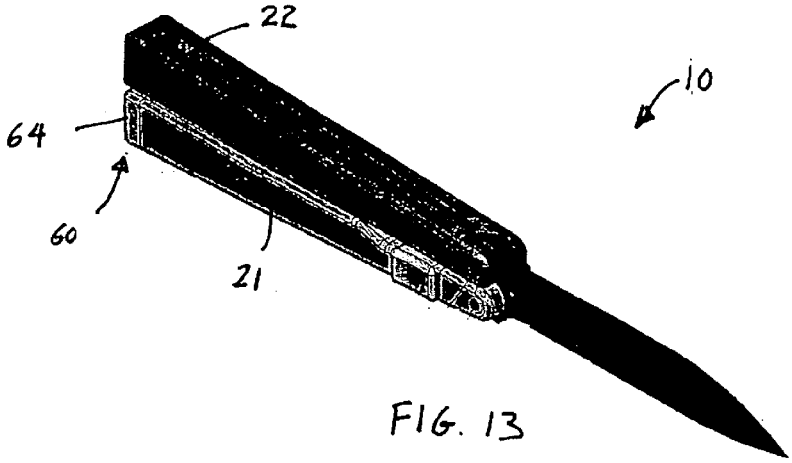
FIG. 13 is an elevated perspective view of a butterfly knife with another embodiment of the thumb lock of the present invention wherein the butterfly knife is in the open and usable position.
Figure 14:
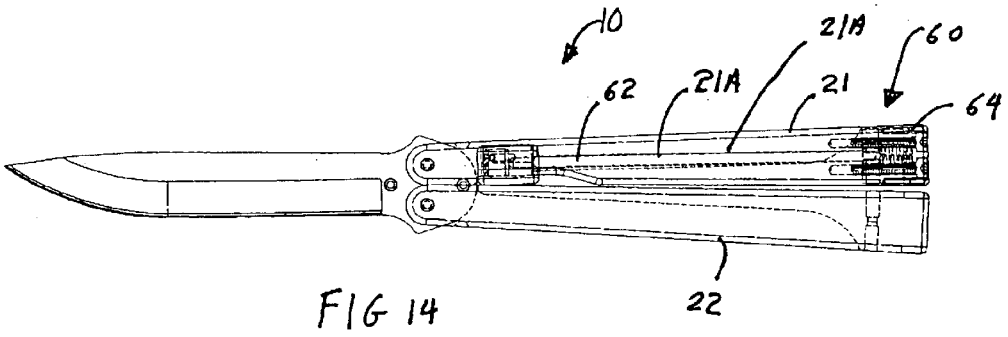
FIG. 14 is a top view of the butterfly knife with the thumb lock depicted in FIG. 13.
Figure 15:
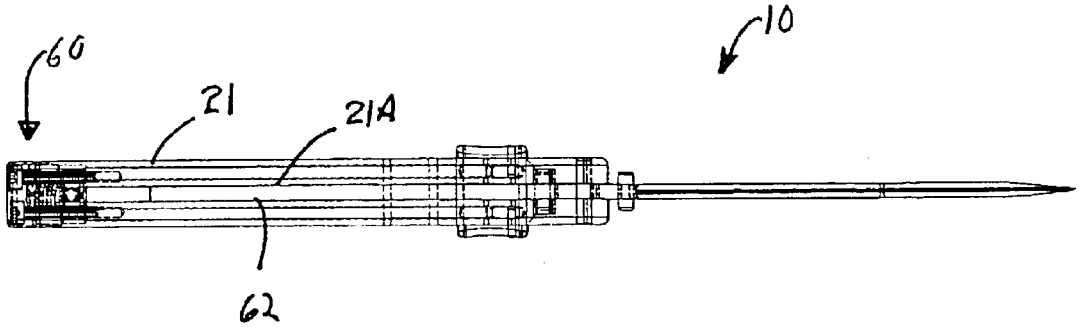
FIG. 15 is a side view of the butterfly knife with the thumb lock depicted in FIG. 13.
Figure 16:
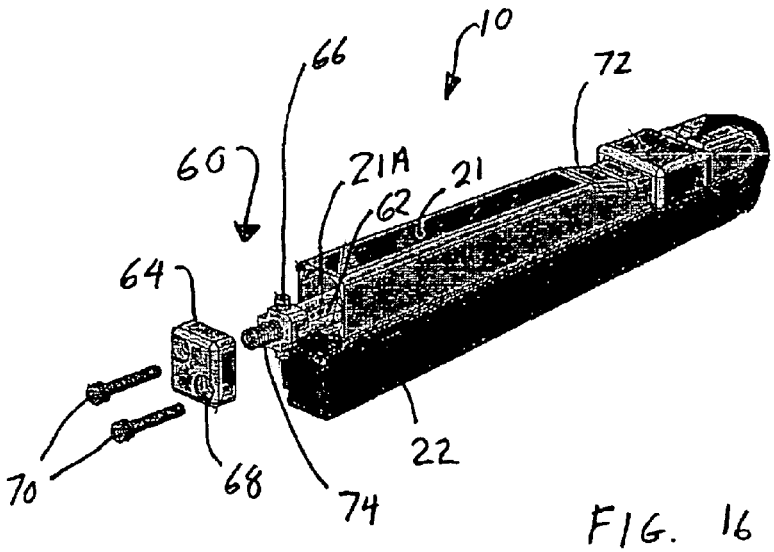
FIG. 16 is an exploded view of the butterfly knife with the thumb lock depicted in FIG. 13 wherein the butterfly knife is in the closed and stored position.

FIGS. 1, 2, and 4 show a full view of a butterfly knife 20. A butterfly knife 20 generally has first handle component 21, a second handle component 22, a blade 24, and a locking mechanism 40. The proximal ends 23 of the first handle component 21 and the second handle component 22 are hingedly coupled to the proximal end 26 of the blade 24 thus allowing the butterfly knife 20 to move between an open and a closed position.

Referring to FIGS. 1–8, one embodiment of the locking mechanism 40 is shown. The locking mechanism 40 has a thin plate 41 coupled to the proximal end 23 of the first handle component 21. One end of the thin plate 41 will be inserted into the first handle component 21 or the second handle component 22 to lock the butterfly knife 20 in either the closed or open position.

In accordance with one embodiment of the present invention, the thin plate 41 has ridged edges 42 that are inserted into the second handle component 22 thereby connecting the first handle component 21 to the second handle component 22. The thin plate 41 also has an opening end 44 and a closing end 45. At the proximal end 23 of the second handle component 22 is an opening surface 47 and a closing surface 48. There is at least one notch 49 for receiving and anchoring the ridged edges 42 of the thin plate 41 on the opening surface 47 and on the closing surface 48. By inserting the opening end 44 into the at least one notch 49 on the opening surface 47, the butterfly knife 20 is secured in an open position. By inserting the closing end 45 into the at least one notch 49 on the closing surface 48, the butterfly knife 20 is secured in a closed position.

Referring to FIGS. 9–12, another embodiment of a locking mechanism 50 is shown. The locking mechanism 50 has at least one movable magnetic component 51 coupled to the proximal end 23 of the first handle component 21 and at least one fixed magnetic component 57 coupled to the proximal end 23 of the second handle component 22. The movable magnetic component 51 has a first opening surface 52 and a first closing surface 53. The fixed magnetic component 57 has a second opening surface 58 and a second closing surface 59. When the first opening surface 52 magnetically couples to the second opening surface 58, the butterfly knife 20 is secured in an open position. When the first closing surface 53 is coupled to the second closing surface 59, the butterfly knife 20 is secured in a closed position. A thumb switch 54 is coupled to the at least one movable magnetic component 51. By sliding the thumb switch 54, the at least one movable magnetic component 51 is disengaged from the at least one fixed magnetic component 57 thereby disconnecting the first handle component 21 from the second handle component 22. A spring 55 is housed within a groove 56 on the proximal end 23 of the first handle component 21. The spring 55 is contiguous to the thumb switch 54 and holds the at least one movable magnetic component 51 in a position always ready to meet the corresponding at least one fixed magnetic component 57.

Referring to FIGS. 13–16, another embodiment of the thumb lock 60 is shown. In this embodiment, the first handle component 21 of the butterfly knife 10 has an internal cavity 21A. The internal cavity 21A runs the length of the first handle component 21. The thumb lock 60 has a rod member 62. The rod member 62 is coupled to the proximate end of the first handle component 21 and runs down the first handle component 21 inside the internal cavity 21A.

A magnetic block 64 is movably coupled to the distal end of the rod member 62. Since the second handle component 22 is made of a metallic material, the magnetic block 64 couples the distal end of the first handle component 21 to the distal end of the second handle component 22. This locks the first handle component 21 and the second handle component 22 together. Thus, the magnetic block 64 will allow one to lock the butterfly knife 10 in an open or closed position. By moving the magnetic block 64 in a downward fashion, the magnetic block 64 disengages from the metallic surface of the second handle component 22. This will unlock the first handle component 21 and the second handle component 22 thereby allowing one to open or close the butterfly knife 10.

In accordance with one embodiment of the present invention, an end cap 66 is coupled to the rod member 62 just above the magnetic block 64. At lease one opening 68 is drilled through the magnetic block 64. A spring device 70 is positioned through the opening 68 and is coupled to the end cap 66. The spring device 70 allows one to pull the magnetic block 64 in a downward motion to unlock the butterfly knife 10. The spring device 70 further automatically retracts the magnetic block 64 once the person releases the downward pressure applied to the magnetic block 64. The magnetic block 64 will thus return to its original position locking the first handle component 21 and the second handle component 22 together.

A switch device 72 may be positioned near the proximate end of the first handle component 21. The switch device 72 is coupled to the magnetic block 64 by a second rod member 74. The switch device 72 will allow a person to lock and unlock the butterfly knife 10 from the proximate end of the first handle component 21. Pressing the switch 72 in a downward manner will push the magnetic block 64 in a downward motion to unlock the butterfly knife 10. Once the switch device 72 is released, the spring device 70 automatically retracts the magnetic block 64 thus returning the magnetic block 64 to its original position locking the first handle component 21 and the second handle component 22 together.

It is intended that the inventions not be limited only to the specific structure, material or acts that are described in the preferred embodiments, but in addition, include any and all structures, materials or acts that perform the claimed function, along with any and all known or later-developed equivalent structures, materials or acts for performing the claimed function. While the invention has been particularly shown and described with reference to preferred embodiments thereof, it will be understood by those skilled in the art that the foregoing and other changes in form and details may be made therein without departing from the spirit of and scope of the invention.

What is claimed is:

1. A device for locking a butterfly knife having a first handle component, a second handle component, and a blade hingedly coupled at a proximal end of the butterfly knife wherein the first and second handle components are moved to an open position and a closed position comprising:

a locking mechanism coupled to a distal end of the butterfly knife for securing the butterfly knife in the open position and in the closed position, wherein the locking mechanism comprises:

a movable magnetic component coupled to a distal end of the first handle component, the magnetic component being magnetically coupled to a metallic surface of the second handle component to lock the butterfly knife; and at least one spring device coupled to the magnetic component for moving the magnetic component in a downward manner to free the magnetic component from the metallic surface of the second handle component to unlock the butterfly knife, the spring device returning the magnetic component to the metallic surface of the second handle component to lock the butterfly knife when the spring device is released.

2. A device for locking the butterfly knife in accordance with claim 1 further comprising:

a rod member running in an internal cavity of the first handle component and coupled to the proximate end of the first handle component; and an end cap coupled to a distal end of the rod member, wherein the spring device is coupled to the end cap.

3. A device for locking the butterfly knife in accordance with claim 1 further comprising a switch located at the proximate end of the first handle component and coupled to the magnetic component for locking and unlocking the butterfly knife.

4. A device for locking the butterfly knife in accordance with claim 3 further comprising a second rod member for coupling the switch to the magnetic component.

5. A device for locking a butterfly knife having a first handle component, a second handle component, and a blade hingedly coupled at a proximal end of the butterfly knife wherein the first and second handle components are moved to an open position and a closed position comprising:

a locking mechanism coupled to a distal end of the butterfly knife for securing the butterfly knife in the open position and in the closed position, wherein the locking mechanism comprises:

a magnetic component moveably coupled to a distal end of the first handle component, the magnetic component being magnetically coupled to a metallic surface of the second handle component to lock the butterfly knife;

at least one spring device coupled to the magnetic component for moving the magnetic component in a downward manner to free the magnetic component from the metallic surface of the second handle component to unlock the butterfly knife, the spring device returning the magnetic component to the metallic surface of the second handle component to lock the butterfly knife when the spring device is released;

a first rod member running in an internal cavity of the first handle component and coupled to the proximate end of the first handle component; and an end cap coupled to a distal end of the rod member, wherein the spring device is coupled to the end cap.

6. A device for locking the butterfly knife in accordance with claim 5 further comprising a switch located at the proximate end of the first handle component and coupled to the magnetic component for locking and unlocking the butterfly knife.

7. A device for locking the butterfly knife in accordance with claim 6 further comprising a second rod member for coupling the switch to the magnetic component.

* * * * *